United States Patent [19]

O'Connor

[11] 4,040,051

[45] Aug. 2, 1977

[54] ELECTROMAGNETICALLY OPERATED AUDIBLE SIGNAL GENERATOR

[75] Inventor: Robert Joseph O'Connor, Greenfield, Ind.

[73] Assignee: Bell Telephone Laboratories, Incorporated, Murray Hill, N.J.

[21] Appl. No.: 738,970

[22] Filed: Nov. 4, 1976

[51] Int. Cl.[2] ..... G10K 9/12

[52] U.S. Cl. ..... 340/397; 340/396; 340/400

[58] Field of Search ..... 340/396, 397, 400

[56] References Cited

U.S. PATENT DOCUMENTS 3,116,481 12/1963 Kalin ..... 340/397

*Primary Examiner*—Harold I. Pitts

*Attorney, Agent, or Firm*—Harry L. Newman

[57] ABSTRACT

An audible signal generator comprises a coil, a pole piece, and an armature movably mounted with respect to the pole piece so that one end of the armature approaches the pole piece upon energization of the coil. The pole piece has a pair of spaced protrusions that extend toward the one end of the armature, and a cantilever spring member is supported on the pole piece so as to extend between the spaced protrusions. The one end of the armature has a protrusion that extends toward the pole piece and is located so as to engage the portion of the spring member in between the spaced protrusions of the pole piece.

10 Claims, 4 Drawing Figures

ELECTROMAGNETICALLY OPERATED AUDIBLE SIGNAL GENERATOR

FIELD OF THE INVENTION

This invention relates to the field of audible signal generators and within that field to electromagnetically operated bells or ringers.

BACKGROUND OF THE INVENTION

U.S. Pat. No. 3,116,481 issued to W. Kalin and R. A. Spencer on Dec. 31, 1963 discloses a polarized ringer of the type used in telephone sets. The ringer includes an armature, one end of which extends between overlapping inner and outer poles of a generally rectangular pole piece. The armature is rotatively mounted on a pivot pin and is moved between the inner and outer poles responsive to magnetic flux generated by the application of a ringing signal to a coil associated with the pole piece. This movement results in a clapper that is mounted on the armature striking an adjacent gong.

The pivot pin about which the armature rotates is offset with respect to the polar axis of a permanent magnet that is positioned between the pivot pin and a portion of the pole piece. A magnetic torque is thereby provided that biases the first end of the armature toward the outer pole. This magnetic bias serves to move the first end of the armature to the outer pole when ringing voltage ceases.

This is important for two reasons. First, when the telephone set with which the ringer is associated is connected to a multiple party telephone line and includes a gas tube in series with the ringer, the ringing signal consists of an ac signal superimposed on a dc bias. The ac signal is rectified by the gas tube to provide dc pulses, and the polarity of the pulses is such as to generate a magnetic field that moves the armature toward the inner pole. Therefore, if the armature when at rest is already positioned at the inner pole, no ringing occurs.

The second reason for having the armature return to the outer pole when ringing voltage ceases is that transient signals are generated when the hookswitch or the rotary dial of the telephone set are operated, and the polarity of these transient signals is such as to move the armature toward the outer pole. Therefore, if the armature when at rest is positioned at the inner pole, bell tap may occur as a result of these transient signals. Most telephone users consider bell tap to be an annoyance.

The magnetic bias that returns the armature to the outer pole when ringing voltage ceases cannot, however, be so strong that the ringing signal on long telephone loops is insufficient to move the armature from the outer pole. Therefore the magnetic bias is such as to be insufficient to move the armature to the outer pole if the armature is in direct engagement with the inner pole at the time ringing voltage ceased.

In the embodiment disclosed in the above-noted W. Kalin et al. patent, this sticking of the armature to the inner pole is avoided by riveting a nonmagnetic spacer to the first end of the armature on the side facing the inner pole. The thickness of the spacer is such that the armature is always spaced far enough from the inner pole so that the bias of the permanent magnet is able to return the armature to the outer pole. This arrangement, however, reduces the travel of the armature, and since the velocity of the armature and thereby the energy imparted to the gong by the clapper carried by the armature is proportional to the travel, the acoustic output of the ringer is reduced.

The solution to this problem as disclosed in the prior art is to attach a nonmagnetic cantilever spring member to the armature in place of the spacer. The spring member is deflected as the armature moves toward the pole, and the spring bias combines with the magnetic bias to return the armature to the outer pole when ringing voltage ceases. The armature can therefore be permitted to move into closer proximity with the inner pole.

This arrangement, however, suffers from several deficiencies. First, with the spring member mounted on the armature, both elements must be moved. This increase in mass that must be moved reduces the velocity of the armature over what it would be without the spring member attached. Since the acoustic output of the ringer is proportional to the velocity of the armature at the time of clapper impact, the acoustic output is accordingly reduced. Second, in the prior art ringers, the spring member is either formed, riveted, or staked in place. This operation adds to the cost of manufacture of the ringer. Finally, in all but one prior art ringer, the spring member needs to be adjusted to provide the necessary spring force. This operation also adds to the cost of manufacture of the ringer.

SUMMARY OF THE INVENTION

The arrangement of the present invention avoids these deficiencies. In accordance with the present invention, the inner pole is embossed with a pair of protrusions that extend toward the armature. The protrusions are spaced from one another and lie along a line that extends generally parallel to the axis of rotation of the armature. A nonmagnetic spring member is positioned on the inner pole, and the spring member includes a cantilever arm that rests on the protrusions. The armature is embossed with a protrusion that extends toward the inner pole and is located so as to engage the portion of the cantilever arm between the protrusions of the inner pole.

Since the spring member is mounted on the pole piece rather than the armature, the mass of the armature is not increased. In addition, the spring member is adapted to be slipped over the pole piece and no attaching operation is necessary to secure it in place. Finally, since the cantilever arm is supported at both ends and center-loaded when engaged by the protrusion of the armature, the spring member requires no adjustment.

DETAILED DESCRIPTION

Figure 1:
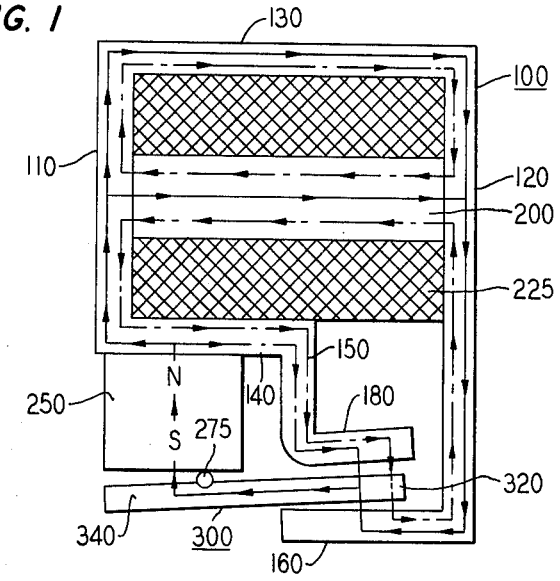
FIG. 1 is a diagrammatic representation of a ringer in accordance with the invention.

Referring to FIG. 1, a ringer in accordance with the present invention includes a generally rectangular ribbonlike magnetic pole piece 100 comprising a pair of spaced opposed side portions 110 and 120, and an end portion 130 joining one end of both side portions, a transverse portion 140 extending toward the side portion 120 from the other end of the side portion 110, and an intermediate portion 150 extending from the transverse portion 140 generally parallel to the side portion 120. The pole piece 100 further includes an outer pole portion 160 that extends from the other end of the side portion 120 and is spaced from and overlaps an inner pole portion 180 extending from the intermediate portion 150.

A magnetic core 200 extends between the side portions 110 and 120 of the pole piece 100, and a coil 225 is disposed about the core. In addition, a permanent magnet 250 is positioned with the north pole thereof in engagement with the transverse portion 140 of the pole piece 100, while a magnetic armature 300 is positioned with one end 320 thereof extending into the airgap between the outer and inner pole portions 160 and 180 (this end of the armature being hereinafter referred to as the pole end), and the opposite end 340 extending adjacent to the south pole of the permanent magnet (this end of the armature being hereinafter referred to as the magnet end). The armature 300 rotates about a pivot pin 275 disposed between the armature and the permanent magnet 250, and the pin is offset from the pole axis of the permanent magnet toward the pole portions 160 and 180. Although not shown, a clapper-bearing member is supported on the armature 300 whereby a gong disposed about the pole piece is struck responsive to the movement of the armature. This structural arrangement is basically the same as that of the ringer disclosed in the previously mentioned Kalin et al. patent, and the reader is directed to this patent for further details.

With the foregoing arrangement, the magnetic flux emanating from the north pole of the permanent magnet 250 enters the transverse portion 140 of the pole piece 100 and traverse three parallel paths shown in solid line in FIG. 1. As indicated by the arrow heads, a first path is through the intermediate portion 150, the inner pole portion 180, the airgap between the inner pole portion and the pole end 320 of the armature 300, through the armature, and back to the north pole of the magnet 250 by way of the airgap between the magnet end 340 of the armature and the magnet. The second path is through the side portion 110, the core 200, the side portion 120, the outer pole portion 160, the airgap between the outer pole portion and the pole end 320 of the armature 300, through the armature itself, and again back to the magnet 250 by way of the airgap between the magnet end 340 of the armature and the magnet. The third path is the same as the second path except that it includes the end portion 130 in place of the core 200.

It is seen that in the first path, the magnetic flux passing through the airgap between the inner pole portion 180 and the pole end 340 of the armature 300 acts to rotate the armature in a counterclockwise direction, while in the second and third paths the magnetic flux passing through the airgap between the outer pole portion 160 and the pole end of the armature acts to rotate the armature in a clockwise direction. However, in all three paths, the magnetic flux passing through the airgap between the magnetic end 340 of the armature 300 and the permanent magnet 250 acts to rotate the armature in a clockwise direction. Thus the permanent magnet 250 serves to bias the pole end 320 of the armature 300 toward the outer pole portion 160.

When a ringing signal is applied to the coil 225 disposed about the core 200, magnetic flux is generated that traverses the paths shown in broken line in FIG. 1. If the ringing signal is a pure ac voltage, the polarity of the signal flux reverses each half cycle. When the signal flux is poled in the direction of the arrows on the broken lines, it is seen that the signal flux is additive to the biasing flux in the airgap between the inner pole portion 180 of the pole piece 100 and the pole end 320 of the armature 300, and it opposes the biasing flux in the airgap between the pole end of the armature and the outer pole portion 160 of the pole piece. As a result, the armature 300 rotates in a counterclockwise direction to move the pole end 320 toward the inner pole portion 180.

When the signal flux is poled opposite to the arrows on the broken lines, it is clear that the signal flux is additive to the biasing flux in the airgap between the outer pole portion 160 of the pole piece 100 and the pole end 320 of the armature 300, and it opposes the biasing flux in the airgap between the inner pole portion 180 of the pole piece and the pole end of the armature. The armature 300 is thereby rotated in a clockwise direction to move the pole end 320 toward the outer pole portion 160.

If the ringing signal consists of dc pulses, such as generated by the application of an ac voltage superimposed on a dc bias and rectified by a gas tube, the signal flux is intermittently generated and it is only poled in the direction shown by the arrows on the broken lines. Thus the signal flux only serves to move the pole end 320 of the armature 300 toward the inner pole portion 180 of the pole piece 100. Because of this and in order to prevent bell tap, it is necessary for the end 320 of the armature 300 to return to the outer pole portion 160 of the pole piece 100 each time ringing voltage ceases. The arrangement shown in FIGS. 2, 3, and 4 provides a spring bias that combines with the bias provided by the permanent magnet 250 to assure this result.

Figure 2:
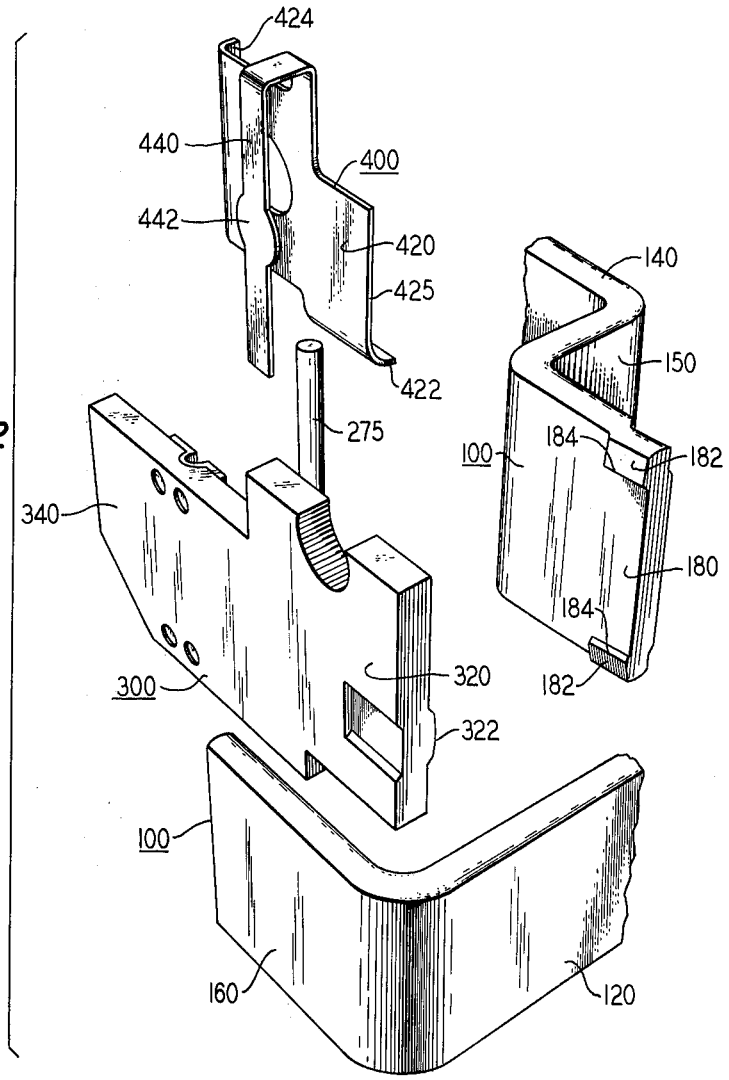
FIG. 2 is an exploded perspective view providing a pictorial representation of the most pertinent elements of the ringer.
Figure 3:
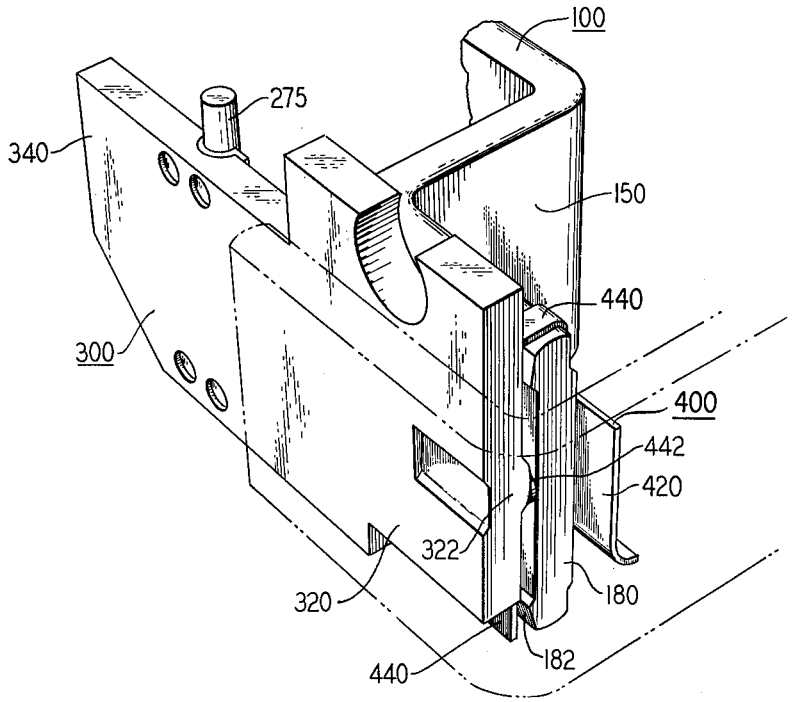
FIGS. 3 and 4 are two perspective view of these elements in an assembled condition.
Figure 4:
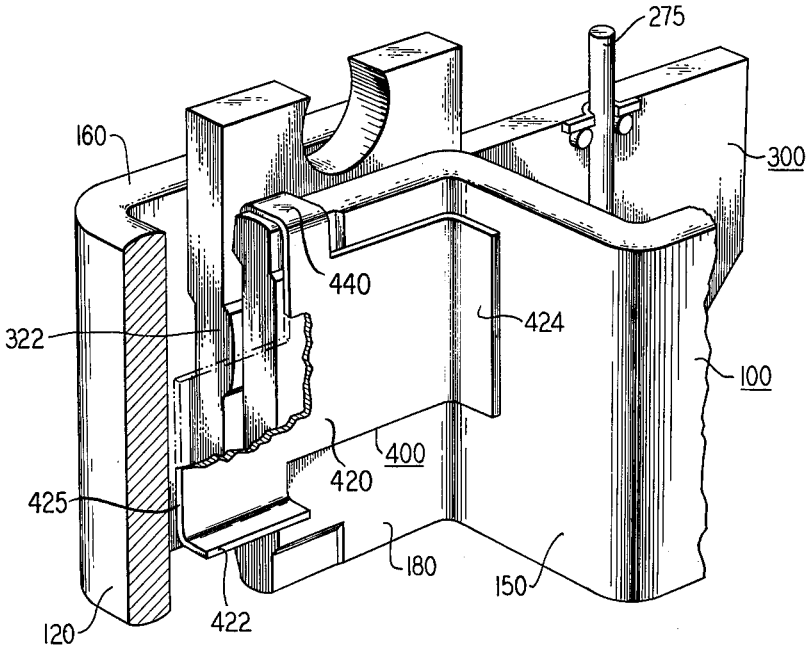

Referring to FIGS. 2, 3, and 4, the inner pole piece 100 includes a pair of spaced elongated protrusions 182 that extend toward the armature 300. The protrusions 182 lie along a line that extends generally parallel to the axis of rotation of the armature 300 and are respectively located at the upper and lower extremities of and at the very end of the pole portion 180. In addition, each protrusion 182 has a triangular profile to provide a linear support edge 184 that extends generally perpendicular to the axis of rotation of the armature 300. The protrusions 182 are advantageously provided by embossing the inner pole portion 180.

Supported on the inner pole portion 180 is a nonmagnetic spring member 400 comprising a locating portion 420 which extends along the face of the inner pole portion that is remote to the armature 300 and a cantilever arm portion 440 which extends over the top of the inner pole portion and along the face adjacent to the armature.

The locating portion 420 has a lower edge 422 that curves away from the arm portion 440 to provide a flared entryway that facilitates the placement of the spring member 400 on the inner pole portion 180. In addition, the locating portion 420 has a side edge 424 that curves away from the arm portion 440, the curved side edge being placed in juxtaposition with a generally conforming curved intersection between the inner pole portion 180 and the intermediate portion 150 of the pole piece 100. Furthermore, the distance between the curved side edge 424 and an opposite side edge 425 is slightly less than the distance between the side portion 120 and the intermediate portion 150 of the pole piece 100. The opposed side edges 424 and 425 therefore serve to locate the spring member 400 in a particular lateral position and in this position the cantilever arm portion 440 overlies the protrusions 182 on the inner pole portion 180. The cantilever arm portion 440 is of a length to bridge both protrusions 182 and includes a circular enlarged section 442 that is situated about midway between the protrusions.

The pole end 320 of the armature 300 extends into juxtaposition with the cantilever arm portion 440 of the spring member 400 and includes a single elongated protrusion 322 that extends toward the inner pole portion 180. The protrusion 322 is located so as to be in line with and centered between the protrusions 182 of the inner pole portion 180 and is therefore juxtaposed with the enlarged section 442 of the cantilever arm portion 440. In addition, the protrusion 322 has a curved surface when viewed in profile, the curvature at the crest of the protrusion being relatively small. Finally, the protrusion 322 is advantageously provided by embossing the pole end 320.

With the foregoing arrangement, when the armature 300 is rotated in a counterclockwise direction, the protrusion 322 on the pole end 320 engages the enlarged section 442 of the cantilever arm portion 440 as the armature moves into close proximity with the inner pole portion 180. The protrusion 322 on the armature 300 initially presses the cantilever arm portion 440 against the support edges 184 of the protrusions 182 on the inner pole portion 180. Continued counterclockwise rotation of the armature 300 causes the protrusion 322 to thereafter deflect the enlarged section 442 of the cantilever arm portion 440 and move it into engagement with the surface of the inner pole portion 180 between the protrusions 182. The cantilever arm portion 440 is thereby bowed and a spring force is generated such that should ringing voltage cease with the armature in that position, the spring force is sufficient to rotate the armature 300 in a clockwise direction to a position wherein the magnetic biasing force of the permanent magnet 250 (FIG. 1) is sufficient to return the armature to the outer pole portion 160.

Because the support edges 184 of the protrusions 182 provide line rather than surface engagement with the cantilever arm portion 440, and because the distance that the center of the cantilever arm portion is deflected is relatively small, the effective length of the arm portion between the support edges remains relatively constant. The spring force provided by the deflection of the cantilever arm portion 440 is thereby reasonably determinable and is reproducible on a mass production basis.

Furthermore, because the surface of the protrusion 322 on the arm 300 is slightly curved, there is a narrow band rather than surface or line engagement between the protrusion and the cantilever arm portion 440. Surface engagement reduces the reproducibility of the spring force generated by the deflection of the arm portion 440, while line engagement results in sufficient pressure at the time of impact to peen the arm portion. The combination of band engagement and the enlarged section 442 of the arm portion 440 results in a reproducible engagement location and a pressure that does not exceed the yield strength of the spring material Although a specific embodiment of the invention has been shown and described, it will be understood that it is but illustrative and that various modifications may be made herein without departing from the scope and spirit of this invention as defined in the appended claims.

What is claimed is:

1. An electromagnetically operated audible signal generator comprising a coil, a pole piece, an armature movably mounted with respect to the pole piece so that one end of the armature approaches the pole piece upon energization of the coil, characterized in that the pole piece has a pair of spaced protrusions that extend toward the one end of the armature, a cantilever spring member is supported on the pole piece so as to extend between the spaced protrusions, and the one end of the armature has a protrusion that extends toward the pole piece and is located so as to engage the portion of the spring member in between the spaced protrusions of the pole piece.

2. An audible signal generator as in claim 1 wherein each of the spaced protrusions on the pole piece has a support edge that provides line engagement between the protrusion and the cantilever spring member.

3. An audible signal generator as in claim 2 wherein the armature is rotatively mounted and the protrusions lie and the cantilever spring member extends along a line that extends generally parallel to the axis of rotation of the armature.

4. An audible signal generator as in claim 3 wherein the linear support edge of each protrusion extends generally perpendicular to the axis of rotation of the armature.

5. An audible signal generator as in claim 4 wherein each protrusion comprises an elongated element having a triangular profile.

6. An audible signal generator as in claim 3 wherein the protrusion on the armature is located so as to be generally in line with and centered between the protrusions on the pole piece.

7. An audible signal generator as in claim 1 wherein the surface of the protrusion on the armature that engages the cantilever spring member is shaped to provide a band of engagement between the protrusion and the spring member.

8. An audible signal generator as in claim 1 wherein the spring member includes means for locating it with respect to the protrusions on the pole piece.

9. An audible signal generator as in claim 1 wherein the pole piece comprises a ribbonlike member resting on a lower edge and having the protrusions on a face thereof adjacent to the armature, the spring member being supported on the upper edge of the pole piece.

10. An audible signal generator as in claim 9 wherein the spring member includes a locating portion that extends along the face of the pole piece remote to the armature and a cantilever arm portion extending along the face adjacent to the armature, the locating portion cooperating with structural features of the pole piece to locate the cantilever arm portion in juxtaposition with the protrusions on the pole piece.

* * * * *